United States Patent [19]

Yoshitake et al.

[11] Patent Number: 4,696,756

[45] Date of Patent: Sep. 29, 1987

[54] ORGANOPOLYSILOXANE COMPOSITION FOR VISCOUS FLUID COUPLING

[75] Inventors: Makoto Yoshitake; Keiichi Kishimoto, both of Tokyo, Japan

[73] Assignee: Toray Silicone Co., Ltd., Tokyo, Japan

[21] Appl. No.: 917,330

[22] Filed: Oct. 9, 1986

[30] Foreign Application Priority Data

Nov. 8, 1985 [JP] Japan ..... 60-250378

[51] Int. Cl.[4] ..... C10M 107/50

[52] U.S. Cl. ..... 252/78.3; 252/49.9; 556/404

[58] Field of Search ..... 252/49.9, 78.3; 556/404

[56] References Cited

U.S. PATENT DOCUMENTS 4,375,420 3/1983 Knollmueller et al. ..... 252/78.3

4,395,527 7/1983 Berger ..... 528/26

FOREIGN PATENT DOCUMENTS 1845780 5/1980 Japan

*Primary Examiner*—Robert A. Wax

*Attorney, Agent, or Firm*—Alexander Weitz

[57] ABSTRACT

A composition for viscous fluid coupling is described. The composition comprises a liquid organopolysiloxane and a reaction product of a liquid organopolysiloxane with an aromatic aminophenol in the presence of a quaternary phosphonium hydroxide. The composition is characterized by a long term stability, undergoing little torque variation even at elevated temperatures and high shear forces.

14 Claims, No Drawings

ORGANOPOLYSILOXANE COMPOSITION FOR VISCOUS FLUID COUPLING

BACKGROUND OF THE INVENTION

This invention relates to an organopolysiloxane composition for viscous fluid coupling. More specifically, this invention relates to a viscous fluid coupling organopolysiloxane composition which is stable for long periods of time and so does not suffer from torque variations at high temperatures and high shear forces.

Because the fluid used for viscous fluid coupling must have properties such as an appropriate viscosity, high flash point, stability against oxidation, stability against thermal decomposition and an insignificant temperature dependence on the part of the viscosity, fluid dimethylpolysiloxanes have generally been used heretofore in this application.

However, by themselves, dimethylpolysiloxane fluids tend to deteriorate after a certain period of time, i.e., suffer from an increase in viscosity or gelation, due to the violent shear forces and frictional heat generated in fluid coupling. Accordingly, they lose their fluid coupling function.

Thus, Japanese Patent 55-18457[18457/80] proposes a working fluid comprising a fluid organopolysiloxane which contains a polysiloxane possessing the N-phenylaminophenyl group and with a degree of polymerization of $\leqq 40$. This working fluid is relatively stable with regard to gelation and viscosity increases at high temperatures and high shear forces.

However, the preceding method suffers from the problem that long-term use in fluid coupling causes a decline in the organopolysiloxane's viscosity due to the high shear forces. A gradual decline in the torque transmission ratio occurs and the fluid coupling function is lost.

SUMMARY OF THE INVENTION

The object of the present invention is to overcome the aforementioned problems by providing a viscous fluid coupling organopolysiloxane composition which is stable on the long-term and which does not undergo torque variations even at high shear forces.

Said object is achieved by a viscous fluid coupling organopolysiloxane composition which is characterized by a composition comprising: An organopolysiloxane composition for viscous fluid coupling, comprising: (i) a liquid organopolysiloxane having the average unit formula $R_aSiO_{(4-a)/2}$ wherein R is a monovalent hydrocarbon radical and a is 1.7 to 2.3; and (ii) a reaction product of (A) an organopolysiloxane having the formula $R'_bSiO_{(4-b)/2}$ wherein R' is a monovalent hydrocarbon group and b is 1.4 to 2.3 with (B) from 0.01 to 10 parts by weight of an aromatic aminophenol per 100 parts of said organopolysiloxane (A), in the presence of(C) from 0.001 to 1.0 part by weight of a quaternary phosphonium hydroxide per 100 parts of said organopolysiloxane (A), wherein the viscosity of said component (ii) is within 20 percent of the viscosity of said component (i) and said component (ii) is present in such quantity that the aromatic aminophenyl groups of said aromatic aminophenol constitutes from 0.01 to 2.00 percent by weight of the total weight of (i) plus (ii). Said object is also achieved when the reaction product (ii) is prepared in the presence of from 0.001 to 1.0 part by weight of a quaternary phosphonium hydroxide per 100 parts of said organopolysiloxane (A) and in the presence of from 0 to 20 parts by weight of an organopolysiloxane cyclic having the general formula $$\left[R_2SiO_n\right]$$

per 100 parts of said organopolysiloxane (A), wherein R is a monovalent hydrocarbon group and n is a integer having a value of 3 to 6.

DETAILED DESCRIPTION OF THE INVENTION

By way of explanation of the present invention, the component (i) used in the present invention is the principal component of this composition and is to have the average unit formula $$R_aSiO_{(4-a)/2}.$$

In this formula, R is a monovalent hydrocarbon group and is exemplified by alkyl groups such as methyl, ethyl, propyl and butyl; substituted alkyl groups such as 2-phenylethyl, 2-phenylpropyl and 3,3,3-trifluoropropyl; alkenyl groups such as vinyl and propenyl; and aryl and substituted aryl groups such as phenyl, tolyl and xylyl. Alkyl and aryl groups are preferred and methyl and phenyl groups are particularly preferred. Furthermore, this component may contain a small quantity of silicon-bonded hydrogen atoms, silicon-bonded hydroxyl groups or silicon-bonded alkoxy groups. In the above formula, a may range from 1.7 to 2.3.

The structure of this component may be straight chain, branched chain, cyclic or network, but straight chain or branched chain is preferred. The terminal group is preferably an organosiloxy group such as a trialkylsiloxy or alkenyldialkylsiloxy group, or an alkoxy or hydroxyl group.

The viscosity of this component is not specifically restricted, but is preferably 100 to 1,000,000 cS at 25° C. from the standpoint of torque transmission, and is more preferably 1,000 to 100,000 cS.

Concrete examples of this component are trimethylsiloxy group-terminated dimethylpolysiloxanes, dimethylvinylsiloxy group-terminated dimethylpolysiloxanes, trimethylsiloxy group-terminated dimethylsiloxane-methylvinylsiloxane copolymers, trimethylsiloxy group-terminated dimethylsiloxane-methylphenylsiloxane copolymers, trimethylsiloxy group-terminated methylphenylpolysiloxanes, hydroxyl group-terminated dimethylpolysiloxanes, hydroxyl group-terminated dimethylsiloxane-methylphenylsiloxane copolymers, and copolymers composed of trimethylsiloxane units and SiO2 units. Also usable are mixtures of a single type, or two or more types, with different structures and/or different numbers of siloxane units.

The component (ii) used by the present invention is the product of the reaction of (A) organopolysiloxane with (B) aromatic aminophenol in the presence of (C) quaternary phosphonium hydroxide. Moreover, its viscosity must be within ±20% of the viscosity of component (i). Its function is to suppress any decline in the torque transmission ratio by the organopolysiloxane composition of the present invention at high shear forces.

The organopolysiloxane (A) used to produce component (ii) is organopolysiloxane with the average unit formula $R^1_bSiO_{(4-b)/2}$.

In this formula, $R^1$ is a monovalent hydrocarbon group and its examples are the same as for R in component (i) and b is 1.4 to 2.3.

The structure of this component may be straight chain, branched chain, cyclic or network, but straight chain or branched chain is preferred. The terminal is preferably an organosiloxy group such as a trialkylsiloxy or alkenyldialkylsiloxy group, or an alkoxy group or hydroxyl group.

The viscosity of the organopolysiloxane of the present component must exceed at least −20% of the viscosity of component (i). The reason for this is that the reaction of this component with component (B) results in a small decline in viscosity, with the result that the viscosity of the reaction product might otherwise not exceed −20% of the viscosity of component (i).

Concrete examples of this component are the same as for component (i).

Concrete examples of the aromatic aminophenol (B) used to produce component (ii) are

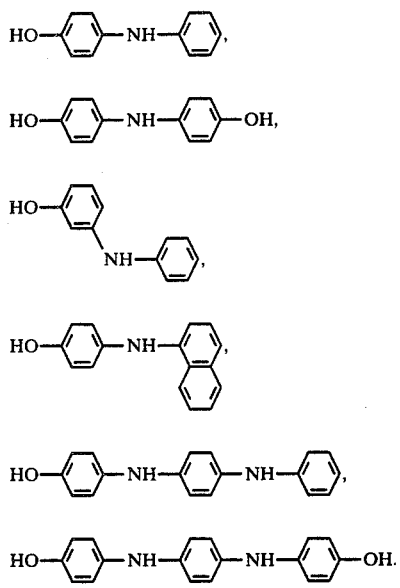

The quaternary phosphonium hydroxide (C) used to produce component (ii) has the formula $R^2_4POH$ wherein $R^2$ may be an alkyl group such as methyl, ethyl, propyl, butyl or octyl. Alternatively, $R^2$ may be an aryl group such as phenyl. Mixtures of $R^2$ groups are also suitable herein, leading to such compounds as methyltriphenylphosphonium hydroxide, for example.

The reaction product comprising component (ii) is produced by reacting organopolysiloxane (A) with aromatic aminophenol (B) in the presence of quaternary phosphonium hydroxide (C).

The reaction ratio between organopolysiloxane (A) and aromatic aminophenol (B) is preferably in the range of 0.01 to 10 parts by weight component (B) per 100 parts by weight component (A) and more preferably in the range of 0.1 to 5 parts by weight component (B) per 100 parts by weight component (A) from the standpoint of reducing the quantity of unreacted component (A) and/or component (B).

The use ratio of component (C) is preferably in the range of 0.001 to 1.0 part by weight component (C) per 100 parts by weight component (A) and more preferably in the range of 0.01 to 0.1 part by weight component (C) per 100 parts by weight component (A).

The reaction temperature is preferably 130°–280° C. and more preferably 150°–250° C.

The reaction atmosphere is the ambient or an inert gas atmosphere.

During this reaction, the reaction mixture first undergoes a gradual decline in viscosity, followed by a nearly constant value, and the reaction is taken to be complete at this point.

Furthermore, a small quantity of organopolysiloxane cyclic can be added to accelerate the reaction. In this case, the cyclic component is preferably stripped off at elevated temperatures under reduced pressures after the reaction.

Also, when unreacted component (A) and/or component (B) remains in the reaction product, they are removed after the reaction by means such as, for example, filtration, in order to obtain a homogeneous, transparent liquid reaction product.

The viscosity of this reaction product must be within ±20% of the viscosity of component (i) from the standpoint of preventing any decline in the torque transmission ratio of the composition of the present invention. It is preferably within ±10% and more preferably within ±5%.

Component (ii) is to be added in a quantity such that the total weight of aromatic aminophenyl groups in component (ii) is 0.01 to 2.00 wt %, and preferably 0.05 to 1.00 wt %, based on the total weight of component (i) plus component (ii).

The composition of the present invention is produced by simply mixing component (i) and component (ii) in the prescribed ratio.

The present invention will be explained in detail using examples of execution. In the examples, "part" denotes "part by weight" and "%" denotes "wt %" and the viscosity is the value measured at 25° C.

EXAMPLE 1

To 100 parts trimethylsiloxy group-terminated dimethylpolysiloxane with a viscosity of 12,500 cS were added 0.6 parts N-phenylaminophenol and 0.03 parts tetrabutylphosphonium hydroxide, followed by mixing at room temperature to obtain a homogeneous dispersion. This mixture was reacted at a temperature of 200° C. under a nitrogen atmosphere. The viscosity reached a nearly constant value 2 hours after the start of the reaction and the reaction product was then cooled to room temperature. The reaction product was then combined with diatomaceous earth and subsequently purified by filtration. The obtained reaction product was a light-yellow, transparent liquid with a viscosity of 5,500 cS.

Ten parts of this reaction product was added to 100 parts of a trimethylsiloxy group-terminated dimethylpolysiloxane with a viscosity of 4,900 cS followed by mixing to homogeneity at room temperature in order to obtain an organopolysiloxane oil with a viscosity of 5,000 cS and an N-phenylaminophenyl group content of 0.05%.

This organopolysiloxane oil was filled into a fluid-coupling device which was then operated continuously at 6,500 rpm and the variation in the output rpm was measured.

The results are reported in Table 1.

COMPARISON EXAMPLE 1

A trimethylsiloxy group-terminated dimethylpolysiloxane with viscosity of 5,000 cS was filled into the fluid-coupling device, which was then continuously operated at 6,500 rpm and the variation in the output rpm is measured.

The results are reported in Table 1.

COMPARISON EXAMPLE 2

To 100 parts trimethylsiloxy group-terminated dimethylpolysiloxane with a viscosity of 5,000 cS was added 0.5 parts organopolysiloxane with the formula

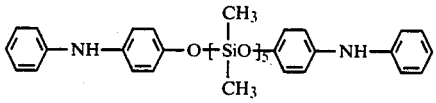

and this was then mixed at room temperature to homogeneity.

This organopolysiloxane oil was filled into the fluid-coupling device, which was subsequently continuously operated at 6,500 rpm and the variation in output rpm was measured.

The results are reported in Table 1.

EXAMPLE 2

To 100 parts trimethylsiloxy group-terminated dimethylpolysiloxane with a viscosity of 1,800 cS was added 10 parts dimethylsiloxane cyclic tetramer. This was mixed at room temperature to homogeneity, then heated to 200° C., 0.8 part N-phenylaminophenol and 0.05 part tetrabutylphosphonium hydroxide were added and this was then reacted at the same temperature under a nitrogen atmosphere. The viscosity reached a nearly constant value 20 minutes after the start of the reaction and the dimethylsiloxane cyclic tetramer was then removed at 200° C./10 mmHg. The reaction product was cooled to room temperature, combined with diatomaceous earth and then purified by filtration. The obtained reaction product was a light-yellow, transparent liquid with a viscosity of 1,000 cS.

Twenty parts of this reaction product was added to 100 parts trimethylsiloxy group-terminated dimethylpolysiloxane with a viscosity of 1,000 cS, followed by mixing at room temperature to homogeneity to obtain an organopolysiloxane oil with a viscosity of 1,000 cS and a 0.13% content of N-phenylaminophenyl groups.

This organopolysiloxane oil was filled into the fluid-coupling device, which was subsequently continuously operated at 6,500 rpm and the variation in output rpm was measured.

The results are reported in Table 1.

Example 3

To 100 parts of trimethylsiloxy group-terminated dimethylsiloxane-diphenylsiloxane copolymer with a viscosity of 10,000 cS (10 mol% diphenylsiloxane units) were added 2.0 parts N-naphthylaminophenol and 0.01 part methyltriphenylphosphonium hydroxide and this was then mixed at room temperature to obtain a homogeneous dispersion. The resulting mixture was then reacted in air at 150° C. The viscosity reached a nearly constant value 2 hours after the start of the reaction and the reaction mixture was then cooled to room temperature, combined with diatomaceous earth and purified by filtration. The obtained reaction product was a light-yellow, transparent liquid with a viscosity of 2,520 cS.

One hundred parts of this reaction product was added to 100 parts of a trimethylsiloxy group-terminated dimethylsiloxane-diphenylsiloxane copolymer with a viscosity of 2,500 cS (10 mol% diphenylsiloxane units) and this was then mixed at room temperature to homogeneity to obtain an organopolysiloxane oil with a viscosity of 2,510 cS and a 0.89% content of N-naphthylaminophenyl groups.

This organopolysiloxane oil was filled into the fluid-coupling device which was then operated continuously at 6,500 rpm and the variation in output rpm was measured.

The results are reported in Table 1.

Comparison Example 3

A trimethylsiloxy group-terminated dimethylsiloxanediphenylsiloxane copolymer with a viscosity of 2,500 cS and a diphenylsiloxane unit content of 10 mol % was filled into the fluid-coupling device, which was then run continuously at 6,500 rpm and the variation in output rpm was measured.

The results are reported in Table 1.

EXAMPLE 4

One hundred parts hydroxyl group-terminated dimethylpolysiloxane with a viscosity of 30,000 cS was combined with 5 parts dimethylsiloxane cyclic tetramer and this was mixed at room temperature to homogeneity. After heating to 250° C., 1.5 parts N-(N-phenylamino phenyl)aminophenol and 0.02 part tetramethylphosphonium hydroxide were added and a reaction was carried out at this temperature under a nitrogen atmosphere. The viscosity reached a nearly constant value 10 minutes after the start of the reaction and the dimethylsiloxane cyclic tetramer was then stripped at 250° C./10 mmHg. The reaction product was cooled to room temperaturecombined with diatomaceous earth and then purified by filtration. The obtained reaction product was a light-yellow, transparent liquid with a viscosity of 13,400 cS.

Ten parts of this reaction product was added to 100 parts hydroxyl group-terminated dimethylpolysiloxane with a viscosity of 12,500 cS and this was then mixed at room temperature to homogeneity in order to obtain an organopolysiloxane oil with a viscosity of 12,600 cS and a 0.13% content of N-(N-phenylaminophenyl-)aminophenyl groups.

This organopolysiloxane oil was filled into the fluid-coupling device, which was then run continuously at 6,500 rpm and the variation in output rpm was measured.

The results are reported in Table 1.

COMPARISON EXAMPLE 4

To 100 parts hydroxyl group-terminated dimethylpolysiloxane with a viscosity of 12,500 cS was added 0.6 part organopolysiloxane with the formula

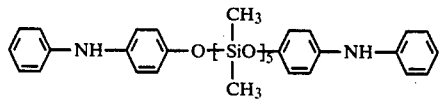

and this was then mixed at room temperature to homogeneity.

This organopolysiloxane oil was filled into the fluid-coupling device which was subsequently run continuously at 6,500 rpm and the variation in output rpm was measured.

The results are reported in Table 1.

TABLE 1

| No. | Initial Viscosity (cS) | Output RPM 1 Hour | 50 Hours | 100 Hours | 300 Hours | Fluid Viscosity After 300 Hours of Operation (cS) |
|---|---|---|---|---|---|---|
| Example 1 | 5000 | 4150 | 4110 | 4090 | 4080 | 4940 |
| Example 2 | 1000 | 2840 | 2830 | 2810 | 2820 | 992 |
| Example 3 | 2510 | 3010 | 2990 | 2970 | 2950 | 2420 |
| Example 4 | 12600 | 4750 | 4740 | 4800 | 4920 | 13900 |
| Comparison Example 1 | 5000 | 4160 | 4390 | gelation | — | — |
| Comparison Example 2 | 5000 | 4140 | 3880 | 3690 | 3890 | 4750 |
| Comparison Example 3 | 2500 | 3000 | 2820 | 2680 | 2420 | 1910 |
| Comparison Example 4 | 12500 | 4750 | 4620 | 4520 | gelation | — |

We claim:

1. An organopolysiloxane composition comprising:

(i) a liquid organopolysiloxane having the average unit formula $$R_aSiO_{(4-a)/2}$$

wherein R is a monovalent hydrocarbon radical and a is 1.7 to 2.3; and (ii) a reaction product of (A) an organopolysiloxane having the average unit formula $$R^1_bSiO_{(4-b)/2}$$

wherein $R^1$ is a monovalent hydrocarbon group and b is 1.4 to 2.3 with (B) from 0.01 to 10 parts by weight of an aromatic aminophenol per 100 parts of said organopolysiloxane (A), in the presence of (C) from 0.001 to 1.0 part by weight of a quaternary phosphonium hydroxide per 100 parts of said organopolysiloxane (A), wherein the viscosity of said component (ii) is within 20 percent of the viscosity of said component (i) and said component (ii) is present in such quantity that the aromatic aminophenyl groups of said aromatic aminophenol constitutes from 0.01 to 2.00 percent by weight of the total weight of (i) plus (ii).

2. The composition of claim 1, wherein said component (i) and said organopolysiloxane (A) are selected from straight chain or branched chain diorganopolysiloxanes.

3. The composition of claim 2, wherein said component (i) has the same structure as said organopolysiloxane (A) and each is selected from dimethylpolysiloxane homopolymers, copolymers of dimethylsiloxane with phenylmethylsiloxane or copolymers of dimethylsiloxane with diphenylsiloxane.

4. The composition of claim 3, wherein the end groups on said component (i) and said organopolysiloxane (A) are selected from trimethylsiloxy or hydroxyl radicals and said component (i) has a viscosity of 1,000 to 100,000 cS at 25° C.

5. The composition of claim 4, wherein said aromatic aminophenol is selected from N-phenylaminophenol, N-(N-phenylaminophenyl)aminophenol or N-naphthylaminophenol.

6. The composition of claim 5, wherein said quaternary phosphonium hydroxide is selected from tetrabutylphosphonium hydroxide, tetramethylphosphonium hydroxide, or methyltriphenylphosphonium hydroxide.

7. The composition of claim 6, wherein said aromatic aminophenol (B) is present in the range of 0.1 to 5 parts by weight and said quaternary phosphonium hydroxide (C) is present in the range of 0.01 to 0.1 parts by weight, each being based on 100 parts of said organopolysiloxane (A).

8. An organopolysiloxane composition comprising:

(i) a liquid organopolysiloxane having the average unit formula $$R_aSiO_{(4-a)/2}$$

wherein R is a monovalent hydrocarbon radical and a is 1.7 to 2.3: and (ii) a reaction product of (A) an organopolysiloxane having the average unit formula $$R^1_bSiO_{(4-a)/2}$$

wherein $R^1$ is a monovalent hydrocarbon group and b is 1.4 to 2.3 with (B) from 0.01 to 10 parts by weight of an aromatic aminophenol per 100 parts of said organopolysiloxane (A), in the presence of (C) from 0.001 to 1.0 part by weight of a quaternary phosphonium hydroxide per 100 parts of said organopolysiloxane (A) and in the presence of (D) from 0 to 20 parts by weight of an organopolysiloxane cyclic having the general formula $$\left[(R_2SiO)_n\right]$$

per 100 parts of said organopolysiloxane (A), wherein R is a monovalent hydrocarbon group and n in an integer having a value of 3 to 6.

9. The composition of claim 8, wherein said component (i) and said organopolysiloxane (A) are selected from straight chain or branched chain diorganopolysiloxanes.

10. The composition of claim 9, wherein said component (i) has the same structure as said organopolysiloxane (A) and each is selected from dimethylpolysiloxane homopolymers, copolymers of dimethylsiloxane with phenylmethylsiloxane or copolymers of dimethylsiloxane with diphenylsiloxane.

11. The composition of claim 10, wherein the end groups on said component (i) and said organopolysiloxane (A) are selected from trimethylsiloxy or hydroxyl radicals and said component (i) has a viscosity of 1,000 to 100,000 cS at 25° C.

12. The composition of claim 11, wherein said aromatic aminophenol is selected from N-phenylaminophenol, N-(N-phenylaminophenyl)aminophenol or N-naphthylaminophenol.

13. The composition of claim 12, wherein said quaternary phosphonium hydroxide is selected from tetrabutylphosphonium hydroxide, tetramethylphosphonium hydroxide, or methyltriphenylphosphonium hydroxide.

14. The composition of claim 13, wherein said aromatic aminophenol (B) is present in the range of 0.1 to 5 parts by weight, said quaternary phosphonium hydroxide (C) is present in the range of 0.01 to 0.1 part by weight and said organopolysiloxane cyclic (D) is present in the range of 0 to 15 parts by weight, each being based on 100 parts of said organopolysiloxane (A).

* * * * *